United States Patent [19]

Hall, Jr.

[11] Patent Number: 4,841,684

[45] Date of Patent: Jun. 27, 1989

[54] SURFACE-FINISHING MEMBER

[76] Inventor: E. Winthrop Hall, Jr., 16 Old Stone Way, Weymouth, Mass. 02189

[21] Appl. No.: 170,102

[22] Filed: Mar. 11, 1988

Related U.S. Application Data

[63] Continuation of Ser. No. 894,074, Aug. 5, 1986, abandoned, which is a continuation of Ser. No. 618,569, Jun. 8, 1984, abandoned.

[51] Int. Cl.[4] ..... B24D 11/00; B24D 11/06

[52] U.S. Cl. ..... 51/400; 51/399; 51/402; 156/148

[58] Field of Search ..... 51/394, 398, 399, 400, 51/401, 402, 404, 407, 295; 156/148; 24/38

[56] References Cited

U.S. PATENT DOCUMENTS

| | | | |
|---|---|---|---|
| 2,958,593 | 11/1960 | Hoover et al. | 51/295 |
| 3,280,517 | 10/1966 | Copeland | 51/400 |
| 3,288,579 | 11/1966 | Coates et al. | 51/295 |
| 3,324,609 | 6/1967 | Stein et al. | 51/400 |
| 3,537,121 | 11/1970 | McAvoy | 15/230.12 |
| 3,688,453 | 9/1972 | Legacy et al. | 51/404 X |
| 3,693,218 | 9/1972 | Jaubert et al. | 24/38 |
| 3,729,873 | 5/1973 | Sandell | 51/399 |
| 3,862,522 | 1/1975 | Mednick | 51/400 |
| 3,991,526 | 11/1976 | Frank et al. | 51/400 X |
| 4,215,516 | 8/1980 | Haschle et al. | 51/399 |
| 4,331,453 | 5/1982 | Dau et al. | 51/400 X |
| 4,369,081 | 1/1983 | Curry et al. | 156/148 |

FOREIGN PATENT DOCUMENTS

| | | | |
|---|---|---|---|
| 0149991 | 11/1979 | Japan | 51/400 |

*Primary Examiner*—Robert P. Olszewski

[57] ABSTRACT

A surface finishing member having an extended working surface adapted for movement repetitively across the surface of an object to be finished, and a method of its manufacture. The member has a body formed of a reinforcement layer lying generally parallel to and spaced substantially below the working surface, the layer being substantially inextensible in a direction of movement, a relatively thick working layer having throughout a large multiplicity of wear-resistant fibers in a random, needled mass, component fibers of the layer being needled through the reinforcement layer, and an elastomeric material impregnated through the working layer and the reinforcement layer. The member may also include pre-applied particles of finishing compound disposed at and adjacent to the working surface. When the finishing member is new, the thickness of the working layer between the working surface and the reinforcement layer is the major thickness of the member. During operation, and as gradual wear of the working layer occurs, the impregnated mass of needled fibers at the working surface continually defines surface interstices in which particles of abrasive compound can lodge and be carried with resilient support across the surface to be finished. In the preferred embodiment the member is in the form of a belt.

12 Claims, 1 Drawing Sheet

SURFACE-FINISHING MEMBER

This is a continuation of application Ser. No. 894,074, filed Aug. 5, 1986, now abandoned, which is a continuation of application Ser. No. 618,569, filed June 8, 1984, now abandoned.

BACKGROUND OF THE INVENTION

This invention relates to surface finishing of metals and the like.

Surface finishing is accomplished by use of a moving finishing member, e.g., a pad, disk or belt, to which abrasive compound is applied. The compound particles are transported repetitively with pressure across the surface of the object to be finished. With each pass, the abrasive particles produce microscopic scratches in the surface, removing relatively more material at the high points and imperfections, until the surface is smooth and, to the eye, has the desired appearance. The characteristics of the compound, i.e., grit or particle size, hardness, etc., determine the type of finish achieved. When very fine grit abrasive is used, a polished surface is achieved or, with coarser particles, a satin or florentine finish results.

It is an objective of this invention to provide a surface finishing member capable of continuous operation over extended lengths of time.

It is also an objective to provide a finishing member which is useful in a production line process and which produces a uniform finish from one object to the next over extended production runs.

It is a further objective to provide a member with a replenishable finishing surface and also a finishing member that may be used safely upon rough or burred surfaces.

Finally, it is desirable that the member be useful in the form of a tensioned belt.

SUMMARY OF THE INVENTION

According to the invention a surface-finishing member having an extended working surface adapted for movement repetitively across the surface of an object to be finished comprises a body formed of a reinforcement layer lying generally parallel to and spaced substantially below the working surface, the reinforcement layer being substantially inextensible in a direction of movement, a relatively thick working layer having throughout a large multiplicity of wear-resistant fibers in a random, needled mass, component fibers of the layer being needled through the reinforcement layer, an elastomeric material impregnated through the working layer and the reinforcement layer; when the finishing member is new, the thickness of the working layer between the working surface and the reinforcement layer comprising the major thickness of the finishing member; during operation, and as gradual wear of the working layer occurs, the impregnated mass of needled fibers at the working surface enabling continual definition of surface interstices in which particles of the abrasive compound can lodge and be carried with resilient support across the surface to be finished.

According to one aspect of the invention, particles of abrasive finishing compound are disposed at and adjacent to the working surface, the particles being lodges in the interstices to produce abrasions in the surface of the object during the repetitive movement thereacross.

According to another aspect of the invention the surface-finishing member has a continuous belt-form body formed as above.

In embodiments of the finishing member including pre-applied finishing compound particles, it is preferred, at least when the member is new, that the particles be disposed throughout at least a portion of the working thickness adjacent to the working surface and, as gradual wear occurs, particles are newly exposed for finishing action; where the particle size of the finishing compound is of the order of about 100 grit, the member is adapted to produce a satin finish upon the surface of the object, and where the particle size of the finishing compound is of the order of at least about 300 grit or finer, the member is adapted to produce a buffed or polished finish upon the surface of the object.

In embodiments of the invention in which the member is in the form of a belt, it is preferred that the reinforcement layer comprises inextensible threads extending in the longitudinal direction, preferably provided in a open scrim; and a backing layer lies below the reinforcement layer, the layer being comprised of a continuation of the mass of needled fibers that define the working layer, and being impregnated with the elastomeric material. Preferably the backing layer is adapted to be locally removed at the opposed ends of the belt to expose the reinforcement layer to permit joining the ends in a continuous belt, more preferably the thickness of the removed backing layer corresponds generally to the thickness of splicing means for joining the ends, whereby a belt of generally constant thickness is formed.

In preferred embodiments of the invention the fibers of the mass are of polyester resin.

According to a further aspect of the invention, a method of forming the described surface-finishing member comprises providing a reinforcement layer of threads, preferably an open-work layer of threads such as open scrim, the layer being substantially inextensible in a direction of movement of the member, providing an outer layer comprised of a large multiplicity of wear-resistant fibers, needling the fibers of the outer layer in a manner to form a relatively thick working layer with the fibers arranged in a random mass extending through the reinforcement layer, impregnating the working layer and the reinforcement layer with an elastomeric material in a manner to embed the reinforcement layer within the material generally parallel to the working surface and spaced therefrom and in a manner to embed the fibers therewithin, portions of the fibers extending to and upon the working surface, and applying particles of abrasive finishing compound to the working surface, at least a portion of the particles lodged in interstices at the working surface, exposed to produce finishing action upon the surface of the object during repetitive transport thereacross; during operation, and as gradual wear of the working layer occurs, the impregnated mass of needled fibers at the working surface being capable of continually defining surface interstices in which particles of the abrasive compound can lodge and be carried with resilient support across the surface to be finished.

In preferred embodiments, the method further comprises applying the particles to the working surface in a manner to cause at least a portion of the particles to penetrate into the working layer adjacent to the surface, whereby as the gradual wear occurs, the particles within the working layer are newly exposed for abrasion of the surface of the object; forming a backing layer below the reinforcement layer, the backing layer comprising a continuation of the mass of needled fibers defining the working layer; and, for forming a surface-finishing belt, forming the member in an elongated belt-form strip with the reinforcement layer aligned to be generally inextensible in the longitudinal direction of the strip, removing the backing layer at the opposed ends of the strip to expose the reinforcement layer, joining the opposed ends by splicing means to form a continuous belt, the thickness of the backing layer overlying the reinforcement layer being predetermined to be generally equal to the thickness of the splicing means whereby the belt has uniform thickness over its length.

Preferred Embodiment

We first briefly describe the drawings:

DRAWINGS

FIG. 5 is a diagrammatic representation of a microphotograph of the surface of the member of FIG. 1 with particles of abrasive finishing compound thereupon, while

Figure 1:
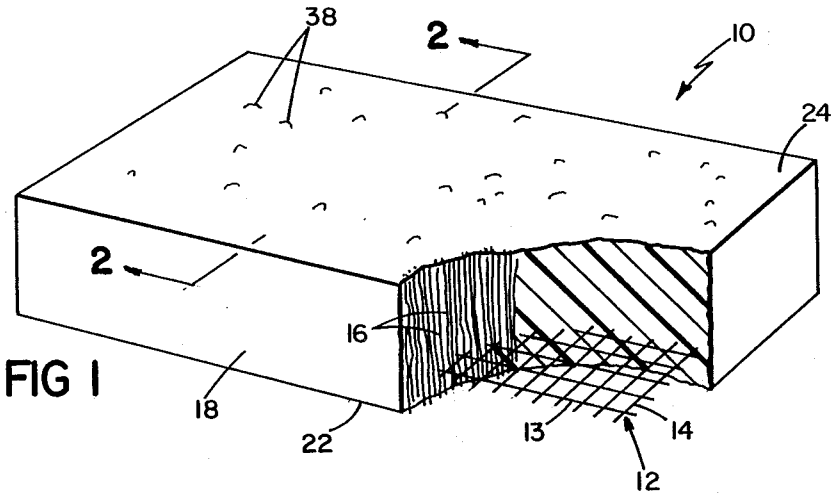
FIG. 1 is a perspective view partially in section of a surface-finishing member according to the invention.
Figure 2:
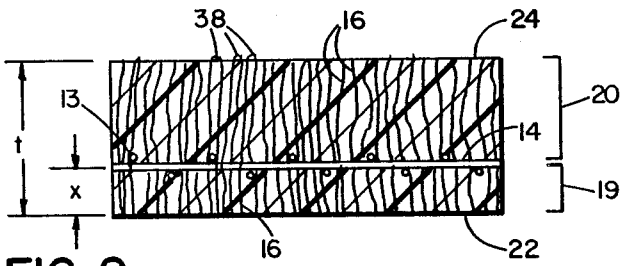
FIG. 2 is a cross-sectional view taken at 2—2 of FIG. 1.

Referring to FIGS. 1 and 2, surface-finishing member 10 consists of a substantially inextensible reinforcement layer 12, typically an open scrim of woven threads 13, 14 laid out in squares of about ⅛ inch on a side. Extending above and below the reinforcement are a large multiplicity of wear-resistant fibers 16 capable of being needled, e.g., cotton or polyester or a blend, that have been needled into a random mass having the appearance of a three dimensional jumble, with component fibers of the mass extending through the reinforcement layer. The fibers are selected on the basis of wear-resistance, needlability, ability to retain finishing compound particles, and the quality of the finish desired to be imparted to the object surface. The presently preferred composition includes polyester polymer, typically as a spun yarn; blends of polyester with rayon monofilament or cotton are also suitable, particularly where the finishing action occurs at relatively high temperature.

Impregnated through the fiber mass and the reinforcement is an elastomeric material 18, e.g. acrylic latex or nitrile rubber, which forms, with the fibers, a backing layer 19 and a working layer 20 at the opposed surfaces of the reinforcement, with the major portion of the thickness of the member comprising the working layer.

Figure 3:
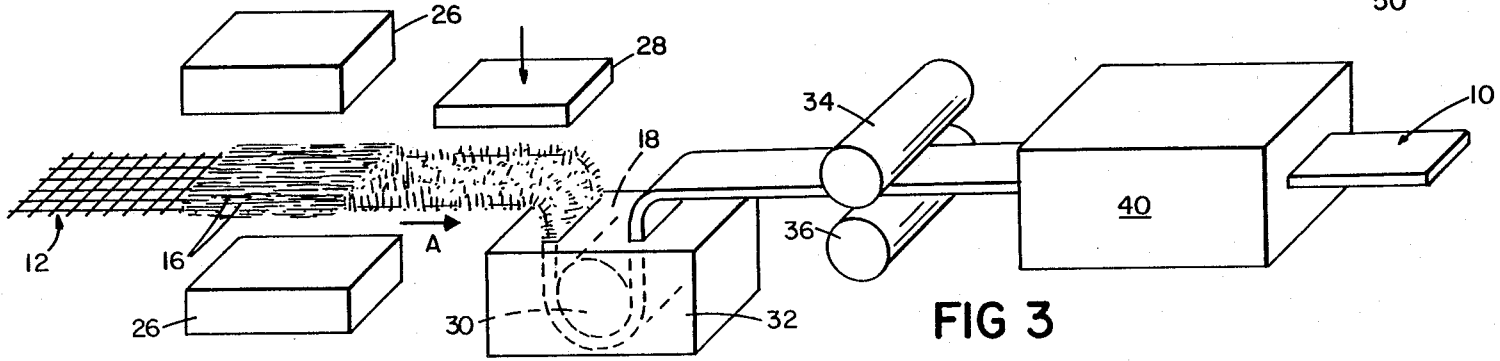
FIG. 3 is a diagrammatic view of one embodiment of the member-forming operation.

Referring to FIG. 3, member 10 may be formed by air laying, 26, five batts of a large multiplicity of discrete fibers 16, onto the reinforcement 12, one batt below to form backing layer 19 and the remaining batts above to form working layer 20. The web with the batts at either face of the reinforcement is extensively needled, 28, to force the fibers through the reinforcement layer as the web moves in the direction indicated by arrow, A. The needled web is passed beneath roller 30 in vat 32 containing elastomeric material 18. The web, now soaked with elastomeric, then passes between squeeze rollers 34, 36 which force the elastomeric into the web to ensure impregnation and remove excess material, the elastomer filling some of the porosity of the web, e.g. at least to about 12 percent of the dry weight pickup of the resin. Passage between the rollers also forms member 10 to the uniform desired thickness, with the reinforcement layer 12 positioned therewithin. The backing layer comprises only a minor portion of the overall thickness of the member, e.g., in the embodiment shown in FIG. 2, the thickness, t, of the member is about 0.100 inch, and the thickness, x, of the backing layer 19 is about 0.005 to 0.008 inch. Ends 38 of the fibers 16 extend to and lie exposed on the surfaces 22, 24 of the member. The web then passes through oven 40 where the elastomer is set and cured.

Figure 4:
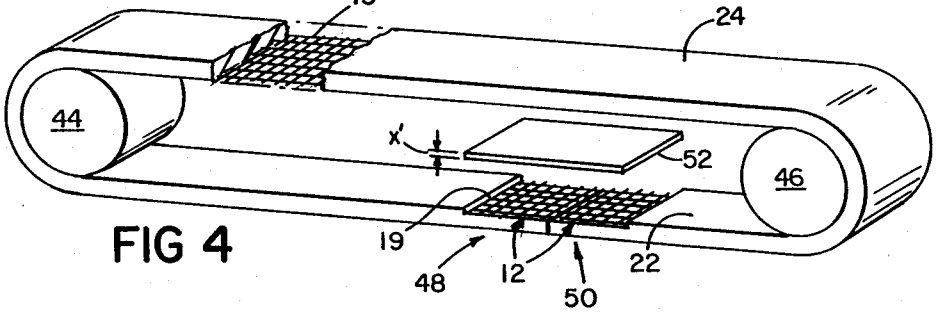
FIG. 4 is a perspective view of a finishing member in the form of a moving belt, with a portion broken away to reveal the substantially inextensible reinforcement layer.

In the completed finishing member, the reinforcement layer 12 provides linear strength, particularly in the direction of the threads 13, 14, to withstand tension without stretching. This is of particular importance in use of the member in the form of a belt, as shown in FIG. 4 and discussed more fully below. The elastomeric material adds strength and tear resistance. Also, the general orientation of the discrete fibers, i.e. with a substantial vertical component and no exposed hard edges, and the woven reinforcement layer deeply embedded remote from the working surface, make the finishing member relatively more safe than devices generally available, as the danger of snagging is greatly reduced. This is of particular importance in deburring, a very important step in metal working and finishing.

Finishing compound is applied to the working surface 24 of the member. The type of finishing compound and the particle size selected depend upon the surface to be finished and the finish desired. To achieve a buffed or polished surface on metal, particles of tripoli or aluminum oxide or, less preferably, fused or unfused alumina, having a mesh size of above 320 grit, or more preferably 500 or 800 to 1000 grit, may be employed. (In this size range, the finishing compounds are referred to as "fines" or "flours".) To achieve a coarser finish, e.g. satin, florentine or other decorative finish, a coarser mesh of less than 320 grit, e.g. 100 or 80 grit, may be employed.

The compound may be provided in liquid form to be applied to the working surface or, more typically, it is provided as a bar. The liquid-form compounds generally are suspensions of particles in soap fats, e.g. triethyl oleamine or oleic acid, and are applied to the finishing member by spraying under extremely high pressure. A portion of the particles penetrate into the member adjacent the working surface, while the remainder lies exposed upon it. The bar form is e.g. of the type sold by Kocour Co. of Chicago, Ill. comprising finishing compound particles dispersed in a binder of stearic acid, grease or oil, e.g. animal fat. In use, the bar is pressed against the moving working surface. Friction heats the bar causing the binder to melt and transfer to the finishing member where it cools and holds the compound particles at or adjacent to the working surface.

Referring to FIG. 4, for use as a belt, member 10 is cut into a strip typically about 132 inches long by 2 to 4 inches wide. The working layer, 19, comprising elastomer 18 and fibers 16 lying below the reinforcement layer 12, is abraded from the opposed ends 48, 50 of the strip to depth, x, to expose layer 12 for application of adhesive-faced tape 52. The depth of layer 12 from the backing surface 22 is preselected whereby thickness, x, corresponds approximately to the thickness, X', of tape 52, thus the belt thickness is constant over its length and variations in buffing effect are avoided. The belt is placed under tension about drive and idler rollers 44, 46.

Figure 5:
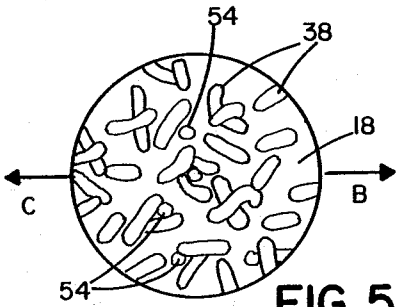
Figure 5A:
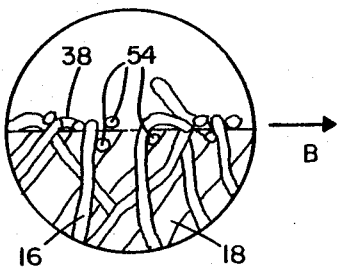
FIG. 5*a* is a similar view taken from the side.

Referring to FIGS. 5 and 5*a*, finishing compound particles 54 lie at or just below the working surface 24 of the member element 10, lodged in interstices extending from the surface formed by the fibers and impregnating elastomeric. In FIG. 5, member 10 is moving to the right, as indicated by arrow, B. Particles 54 are resiliently fixed and engage in the interstices formed by exposed portions of the elastomer in direction C, counter to direction B, until engaging upon the exposed ends 38 of the fibers 16, which hold the particles against further lateral movement. In this manner, extended lateral movement of the particles, which results in element wear as well as in less effective buffing action per unit of belt travel, is prevented. Also referring to FIG. 5*a*, the particles of finishing compound are held exposed upon the working surface of the member for contact with the surface of the object to be finished, or are held just below the working surface, and are not lost as would be typical of prior art fiber finishing elements; thus product yield and efficiency are improved.

As gradual wear of the working surface occurs, e.g. due to surface-to-surface friction, the impregnated mass of needled fibers 16 at the working surface 24 continually defines surface interstices in which particles of compound can lodge, and also exposes fresh particles of compound disposed beneath the working surface, the particles being continually carried with resilient support across the surface to be finished. The finishing process can continue with the same member, with addition of compound as desired, until the working layer is almost totally worn away.

OTHER EMBODIMENTS

Other embodiments are within the following claims. For example, the member 10 may also take the form of a pad, disk or other surface finishing device, e.g., for use on existing equipment, e.g. as a 50-inch wide belt on a polishing table or as a square or round pad or disk on a Buehler-type lapping machine. Finishing compounds comprised of other materials and having different particle size may be employed depending on the object to be finished and the finish desired, e.g. a very fine compound of cerium oxide may be employed for polishing terminations of bundles of fiber optics. Compounds of silicone carbide, garnet, talc and other materials may also be employed. The fibers may be applied to reinforcement layer by methods other than by airlaying, and the backing layer may be formed by needling the ends of fibers in the working layer to extend beyond the underside of the reinforcement layer.

What is claimed is:

1. An elongated member comprising a body of a large multiplicity of wear-resistant fibers in a random, needled mass impregnated with an elastomeric material in an amount and disposition such that said impregnated, needled mass contains interstitial voids and free of particles of abrasive finishing compound, said member defining an extended working surface adapted for receiving, in voids therein, particles of abrasive finishing compound of desired grit, and, with abrasive finish compound particles in said working surface voids and operatively exposed at said working surface, said member adapted for surface finishing movement repetitively across a surface of an object to be finished, said body formed of:

a reinforcement layer lying generally parallel to and spaced substantially below said working surface, said layer being substantially extensible in a direction of movement, a relatively thick working layer lying above said reinforcement layer, said working layer having throughout a large multiplicity of wear-resistant fibers in a random, needled mass, component fibers of said layer being needled through said reinforcement layer, a backing layer lying below said reinforcement layer, said backing layer being comprised of a continuation of said mass of needled fibers that define said working layer, and said elastomeric material impregnated through said working layer, said backing layer and said reinforcement layer in a manner to fill some of the porosity of the mass of fibers, when said finishing member is new, the thickness of said working layer between said working surface and said reinforcement layer comprising the major thickness of said finishing member, the ratio of thickness of said backing layer to the overall thickness of said member being of the order of between about 1:20 to 1:12, whereby, during operation, and as gradual wear of said working layer occurs, said impregnated mass of needled fibers at said working surface enables continual definition of surface interstices in which particles of abrasive compound applied to said working surface can lodge and can be carried with resilient support across a surface to be finished.

2. The surface finishing member of claim 1 wherein, at least when said member is new, particles of finishing compound disposed upon said working surface extend throughout at least a portion of said working layer adjacent to said working surface, and as said gradual wear occurs, particles are newly exposed for abrasion of a surface of an object.

3. The surface finishing member of claim 1 wherein the particle size of finishing compound is of the order of about 100 grit, and said member is adapted to produce a decorative finish upon a surface of an object.

4. The surface finishing member of claim 1 wherein the particle size of finishing compound is at least 300 grit, and said member is adapted to produce a buffed or polished finish upon a surface of an object.

5. The surface finishing member of claim 1 wherein said body is in the form of a continuous belt and said reinforcement layer is substantially inextensible in at least the longitudinal direction of said belt.

6. The surface finishing member of claim 1 wherein said fibers of said mass are comprised of polyester resin.

7. An elongated member comprising a continuous belt-form body of a large multiplicity of wear-resistant fibers in a random, needled mass impregnated with an elastomeric material in an amount and disposition such that said impregnated, needled mass contains interstitial voids and free of particles of abrasive finishing compound, said member defining an extended working surface adapted for receiving there upon, in voids therein, particles of surface finishing compound and, with surface finishing compound particles in said working surface voids and operatively exposed at said working surface, adapted for movement repetitively across a surface of an object to be finished, said continuous belt-form body formed of:

a reinforcement layer lying generally parallel to and spaced substantially below said working surface, said layer being substantially inextensible to the longitudinal direction of said belt, a relatively thick working layer lying above said reinforcement layer, said working layer comprised throughout a large multiplicity of wear-resistant fibers in a random, needled mass, component fibers of said layer being needled through said reinforcement layer, a backing layer lying below said reinforcement layer, said backing layer being comprised of a continuation of said mass of needled fibers that define said working layer, and said elastomeric material impregnated throughout said working layer, said backing layer and said reinforcement layer in a manner to fill some of the porosity of the mass of fibers, when said finishing member is new, the thickness of said working layer between said working surface and said reinforcement layer comprising the major thickness of said finishing belt, the ratio of thickness of said backing layer to the overall thickness of said member being of the order of between the 1:12 to 1:20, during operation, and as gradual wear of said working layer occur, said impregnated mass of needled fibers at said working surface enabling the continual definition of surface interstices in which particles of abrasive compound applied to said working surface can lodge and be carried, with resilient support, across a surface to be finished.

8. The surface finishing member of claim 7 wherein said fibers of said mass are comprised of polyester resin.

9. The surface finishing member of claim 7 wherein said reinforcement layer comprises an open scrim having substantially inextensible warp threads extending in the longitudinal direction.

10. The elongated member of claim 7 wherein said belt comprises a strip having opposed ends, said backing layer, in a splice region, being locally removed at the opposed ends of said belt to expose said reinforcement layer, and a tape-form splicing member being adhered to the reinforcement layer at each end in said splice region, to permit joining said ends in a continuous belt, the backing layer overlying the reinforcement layer and the tape-form splicing member being of generally equal thickness whereby there is formed a continuous belt having generally constant thickness in the splice region.

11. A surface finishing system comprising:

an endless belt adapted to be inpinged against a work surface;

means to drive said belt;

a work surface to be finished; and multiple abrasive particles means of various abrasive quality:

wherein said belt comprises:

a reinforcing layer substantially parallel to the direction in which said belt is driven;

a relatively thick working layer, juxtaposed said reinforced layer and defining a working surface, comprising a large multiplicity of wear-resistant fibers disposed in a random, needled mass wherein some of said fibers are needled through and thereby anchored to said reinforcing layer, said working layer having its smallest dimension substantially perpendicular to said direction in which said belt is driven, said working layer having a greater length than said reinforcing layer;

an elastomeric impregnant in at least said working layer in a quantity and disposition such as to produce an impregnated working layer having the largest dimension of said belt and comprising interstitial void spaces in said working surface as made and as exposed in use adapted to resiliently support and house said abrasive means; and an elastomer impregnated backing layer comprising a large multiplicity of wear-resistant fibers disposed in a random, needled mass wherein at least some of said fibers are needled through and thereby anchored to said reinforcing layers, said backing layer having a largest dimension substantially parallel to said direction in which said belt is driven and having a smaller length than said reinforcing layer;

whereby:

said working layer extended surface is initially combined in the interstices thereof with selected abrasive quality abrasive particle means;

said extended surface is impinged against said work surface and driven with respect thereto for a time sufficient to wear down said extended surface and to expel at least a substantial portion of said abrasive particles;

and the new working surface exposed by said wearing down is combined in the interstices thereof with selected abrasive quality abrasive particle means.

12. A system as claimed in claim 11 wherein, prior to combining said endless belt with said abrasive particle means, said backing layer comprises about 1/12 to 1/20 of the thickness of said belt.

* * * * *